US012486002B1

(12) United States Patent
Ergle

(10) Patent No.: US 12,486,002 B1
(45) Date of Patent: Dec. 2, 2025

(54) BOAT COVER SUPPORT APPARATUS

(71) Applicant: Monty K. Ergle, Ocala, FL (US)

(72) Inventor: Monty K. Ergle, Ocala, FL (US)

( * ) Notice: Subject to any disclaimer, the term of this patent is extended or adjusted under 35 U.S.C. 154(b) by 0 days.

(21) Appl. No.: 19/227,188

(22) Filed: Jun. 3, 2025

Related U.S. Application Data

(60) Provisional application No. 63/655,539, filed on Jun. 3, 2024.

(51) Int. Cl.
*B63B 17/02* (2006.01)

(52) U.S. Cl.
CPC ..... *B63B 17/02* (2013.01)

(58) Field of Classification Search
CPC ..... B63B 17/02
See application file for complete search history.

(56) References Cited

U.S. PATENT DOCUMENTS 4,075,723 A * 2/1978 Bareis ..... B63B 17/02 114/364
5,070,807 A * 12/1991 Lewis ..... B63B 17/02 114/361
9,027,499 B1 * 5/2015 Clarke ..... B63B 17/00 114/361
10,994,809 B2 * 5/2021 Desautels ..... B63B 17/02

* cited by examiner

*Primary Examiner* — Anthony D Wiest
(74) *Attorney, Agent, or Firm* — Douglas Wm. Massinger, Esq.

(57) ABSTRACT

An apparatus and system for preventing sagging of a boat cover on a trailer or lift-mounted boat in order to prevent pooling of water on the cover, the apparatus and system comprising at least one flexible resilient rod adapted to span in arched configuration opposing gunwales of a boat, rod retention means for receiving opposite ends of each at least one rod, and a tie-down strap adapted for mounting across the opposing gunwales, the rod retention means being pivotally mounted to the tie-down strap.

3 Claims, 15 Drawing Sheets

(ISO View)

(Top View)

(Side View)

(Front View)

(Side View)

(Top View)

BOAT COVER SUPPORT APPARATUS

CROSS-REFERENCE TO RELATED APPLICATIONS

This application claims the benefit of U.S. Provisional Application No. 63/655,539 filed Jun. 3, 2024 and entitled, Support for Boat Covers.

FIELD OF THE INVENTION

The subject invention relates to an accessory apparatus for boat covers, generally, and to a collapsible support apparatus and system therefore, in particular.

BACKGROUND OF THE INVENTION

Motor boating is popular among anglers, waterskiers and cruisers. In the United States alone, an estimated 100 million people go boating each year. The U.S. recreational boat market is also expected to grow at a compound annual growth rate ("CAGR") of approximately 8.69% from 2022 to 2028, due to increased demand for outboard power boats and the growth of the tourism industry.

It has been reported that ninety-five percent (95%) of boats on the water in the U.S. are less than 26 feet, which can be trailered by a vehicle to local waterways for launch. Accordingly, it is a common practice for boat owners to leave their boats on a trailer between uses. It is also commonplace to cover the boat while not in use to protect the boat from UV rays, debris, inclement weather and wildlife to prolong its lifespan and maintain its value. Boat covers also act as a deterrent to theft of equipment and personal property stored in the boat.

A common problem associated with many boat covers is that they tend to sag in places that will collect water and debris and become rancid. Larger pools of standing water can be so heavy that they cause the cover to rip and be unusable. Even if the cover does not tear, larger volumes of water are too heavy to remove by lifting the cover and must typically be bailed off of the cover, a practice that is inconvenient and time consuming. The problem is exacerbated during cover removal if the pooled water accidentally leaks into the boat. In order to resolve this problem, a variety of boat cover support apparatus have been made commercially available. Some of these use a height adjustable pole placed between the boat deck and boat cover. The top of the pole is usually equipped with a disc to increase the load bearing surface from a pinpoint to a greater surface area so as not to damage the cover. Floor-to-cover support systems typically require an array of straps extending between the top of the pole and various attachment points around the perimeter of the boat to prevent the pole from toppling over and to support the overlying boat cover. Some of these straps are long and prone to sagging over time. As a result, portions of the cover that are insufficiently supported will accumulate water the weight of which can cause the pole to topple or break or cause the cover to tear.

Other support assemblies are comprised of a rigid network of framing members, typically made out of PVC and various couplings. Such support systems tend to include multiple parts which must be arranged in a specific manner every time the cover is put in use which is an overly burdensome and tedious process. Moreover, when such systems are broken down for cover removal, the parts must be stored remotely from the boat because of their bulk.

A variation of the above support assemblies comprise permanent framing structures that are collapsable into a more compact folded configuration when not in use. Such systems frequently require hard-mounting to the boat making them undesirable by owners who prefer not to damage their investments with invasive hardware. Another shortcoming of such systems is that they take up valuable surface area along the boat gunwales when collapsed.

U.S. Pat. No. 4,075,723 teaches a boat cover means comprising a boat cover supported by at least one flexible resilient rib adapted to extend in arched configuration between adjacent gunwales for supporting the cover. A substantial shortcoming of this design is that the ribs are attached to the boat cover in specific locations and thus each cover must be sized for a specific boat of a specific perimeter shape, size and rib layout. In other words, the teachings of the '723 patent necessitate the creation of a boat cover means customized for each particular boat type which would require a massive number of stock keeping units (SKUs) and sellers to carry a large inventory. Moreover, boat owners who already own a cover that requires support would have to purchase the combined cover and support means as opposed to just a support system rendering their existing cover useless.

Accordingly, there has existed a long-standing need in the art for a boat cover support apparatus that does not suffer from the above shortcomings and limitations of the prior art.

SUMMARY OF THE INVENTION

The subject invention meets the above-described need in the art by providing a boat cover support apparatus and system for improving the cover's ability to shed water during use. In one aspect, the invention comprises an apparatus for supporting a boat cover over a boat in canopy-like fashion when the boat is mounted on a trailer or lift. An embodiment of the apparatus comprises a flexible resilient rod adapted to span in arched configuration opposing gunwales of a boat for supporting a boat cover thereon and above the boat, adjustable rod retention means for receiving opposite ends of the rod, and a tie down assembly adapted for mounting to a tie down object across the opposing gunwales, the rod retention means being fixedly mounted to the tie down assembly.

In some embodiments, the rod retention means is comprised of a pair of soft (i.e., made of webbing material) "holsters" for receiving opposite ends of the support rod. Each soft holster is pivotally mounted to the tie down assembly to provide the rod with freedom of movement. In other embodiments, the rod retention means is comprised of a pair of hard (i.e., made of plastic or metal, for instance) holsters for receiving opposite ends of the support rod. Each holster is pivotally mounted to a separate angle bracket for mounting over the corner of a boat gunwale. In all embodiments, the ends of the support rod extend beyond the outer edge of the boat gunwales when the rod is mounted within the rod retention means.

In another aspect, the invention comprises a system for supporting a boat cover on a trailer or lift-mounted boat, a first embodiment of the system comprises at least two flexible resilient rods each adapted to span in arched configuration adjacent gunwales of a boat for supporting a boat cover above the boat, rod retention means for receiving opposite ends of each at least two rods, and a tie down assembly adapted for mounting to a tie down object across the opposing boat gunwales, the rod retention means each being pivotally mounted to the tie down assembly. In some embodiments, each of the at least two rods is attached at its midpoint to a perpendicular rod stabilization assembly adapted for mounting between the bow and stern of the boat; the rod stabilization assembly preventing each arched rod from tipping in a direction perpendicular to its longitudinal axis.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is, therefore, a primary object of the subject invention to provide a boat cover support apparatus and system which is adjustable to support a broad and diverse range of boat covers of varying sizes and shapes.

It is also a primary object of the subject invention to provide a boat cover support apparatus and system that do not require mounting hardware that must be fixedly attached to the boat.

Yet another primary object of the subject invention is to provide a boat cover support apparatus and system comprised of relatively few parts and, therefore, which is capable of rapid installation and uninstallation.

Still another primary object of the subject invention is to provide a boat cover support apparatus and system that may be broken down into a highly compact and lightweight configuration for easy transport or onboard storage.

Another object of the subject invention is to provide boat cover support apparatus and system that is susceptible of a low cost of manufacture with regard to both materials and labor, and which accordingly is then susceptible of low prices of sale to the consuming public.

These together with other objects of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated a preferred embodiment of the invention.

BRIEF DESCRIPTION OF DRAWINGS

The invention will be better understood and objects other than those set forth above will become apparent when consideration is given to the following detailed description thereof. Such description makes reference to the annexed drawings wherein corresponding reference numerals and characters indicate corresponding structural elements, portions or surfaces consistently throughout, as such elements, portions or surfaces may be further described or explained by the entire written specification. Elements in the several figures are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood elements that are useful or necessary in commercially feasible embodiment are often not depicted in order to facilitate a less obstructed view of these various embodiments of the present disclosure. One of ordinary skill in the art will also appreciate that a component may be designed as multiple components or that multiple components may be designed as a single component.

DETAILED DESCRIPTION OF THE INVENTION

1. Definitions and Meanings

Figure 1:
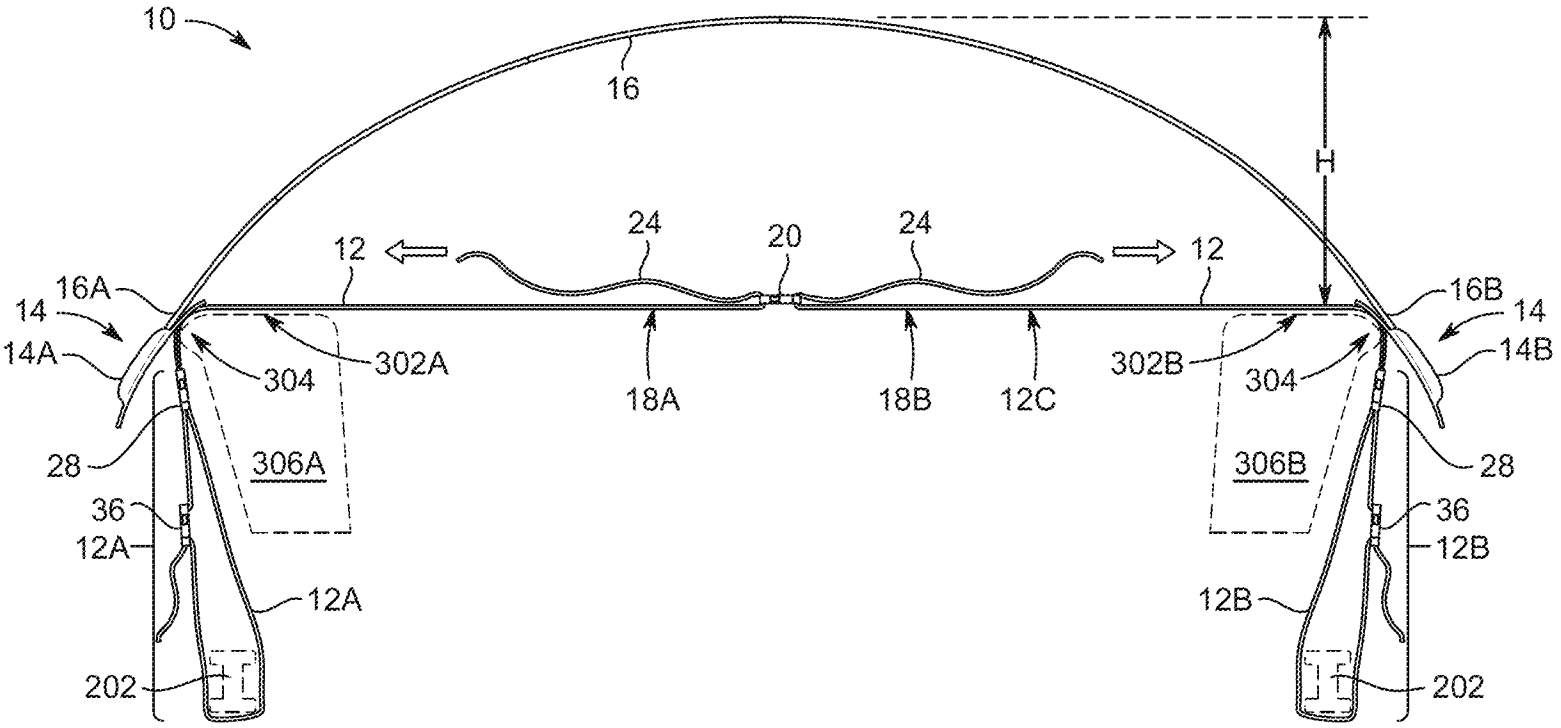
FIG. 1 is a front sectional view along line 1-1 of FIG. 5 illustrating an embodiment of the boat cover support apparatus of the subject invention shown attached to a trailer-mounted boat, certain details of which have been removed for the sake of simplicity.

Unless defined otherwise, all technical and scientific terms used herein have the same meaning as commonly understood by a person having ordinary skill in the art.

The present application may also reference quantities and numbers. Unless specifically stated, such quantities and numbers are not to be considered restrictive, but exemplary of the possible quantities or numbers associated with the present application. In this regard, the present application may use the term "plurality" to reference a quantity or number. In this regard, the term "plurality" is meant to be any number that is more than one, for example, two, three, four, five, etc. The phrases "at least one," "one or more," and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together, and further includes all similar permutations when any other quantity of elements is listed.

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

The terms "about," "approximately," "near," etc. generally refer to a range of numbers that one of skill in the art would consider equivalent to the recited value (for example, having the same function or result). In many instances, these terms may include numbers that are rounded to the nearest significant figure. Unless otherwise stated, as used herein, the terms "about," "approximately," "near," etc., mean plus or minus 20 percent of the recited value, so that, for example, "about 0.125" means 0.125±0.025, and "about 1.0" means 1.0±0.2. All numeric values are herein assumed to be modified by the term "about," whether or not explicitly indicated.

Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape.

In everyday usage, indefinite articles (like "a" or "an") precede countable nouns and noncountable nouns almost never take indefinite articles. It must be noted, therefore, that, as used in this specification and in the claims that follow, the singular forms "a," "an," and "the" include plural referents unless the context clearly dictates otherwise. Thus, for example, reference to "a support" includes a plurality of supports. Particularly when a single countable noun is listed as an element in a claim, this specification will generally use a phrase such as "a single." For example, "a single support."

The present application may include references to directions or locations, such as "forward," "rearward," "front," "rear," "upward," "downward," "top," "bottom," "right hand," "left hand," "lateral," "medial," "proximal," "distal," "in," "out," "extended," etc., as well as adjectival and adverbial derivatives thereof (e.g., "horizontally", "rightwardly", "upwardly", etc.). These references, and other similar references in the present application, are only to assist in helping describe and to understand the particular embodiment and are not intended to limit the present disclosure to these directions or locations. The terms "inwardly" and "outwardly" generally refer to the orientation of a surface relative to its axis of elongation, or axis of rotation, as appropriate.

The terms "comprising," "including," and "having" can be used interchangeably herein.

Also, as used herein, terms such as "positioned on" or "supported on" mean positioned or supported on but not necessarily in direct contact with the surface.

2. Embodiments of the Invention

Certain exemplary embodiments will now be described to provide an overall understanding of the principles of the structure, function, manufacture, and use of the device and methods disclosed herein. One or more examples of these embodiments are illustrated in the accompanying drawings. The detailed description set forth below in connection with the appended drawings are intended as a description of various embodiments of the present disclosure and are not intended to represent the only embodiments. Each embodiment described in this disclosure is provided merely as an example or illustration and should not be construed as precluding other embodiments. In the following description, specific details are set forth to provide a thorough understanding of exemplary embodiments of the present disclosure. It will be apparent to one skilled in the art, however, that the embodiments disclosed herein may be practiced without embodying all of the specific details. In some instances, well-known components or process steps have not been described in detail in order not to unnecessarily obscure various aspects of the present disclosure. Further, it will be appreciated that embodiments of the present disclosure may employ any combination of features described herein.

Furthermore, reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "in some embodiments", "one example" or "an example" in various places throughout this specification are not necessarily all referring to the same embodiment or example. Furthermore, the particular features, structures or characteristics may be combined in any suitable combinations and/or sub-combinations in one or more embodiments or examples.

All the features disclosed in this specification (including any accompanying claims, abstract, and drawings) may be replaced by alternative features serving the same, equivalent, or similar purpose, unless expressly stated otherwise. Thus, unless expressly stated otherwise, each feature disclosed is one example only of a generic series of equivalent or similar features. The examples and embodiments described herein are for illustrative purposes only and that various modifications or changes in light thereof will be suggested to the person having ordinary skill in the art and are to be included within the spirit and purview of this application. Many variations and modifications may be made to the embodiments of the disclosure without departing substantially from the spirit and principles of the disclosure. All such modifications and variations are intended to be included herein within the scope of this disclosure. For example, unless otherwise indicated, the present disclosure is not limited to particular materials, fasteners or other hardware, manufacturing processes, or the like, as such can vary. It is also to be understood that the terminology used herein is for purposes of describing particular embodiments only and is not intended to be limiting. It is also possible in the present disclosure that steps can be executed in different sequence where this is logically possible.

It should first be appreciated that the boat cover support apparatus of the subject invention is intended for use in connection with summer storage type boat covers generally (as opposed to winter covers designed to carry heavy snow loads), including those of the tie-down, snap-on and ratchet strap varieties, to prevent water from pooling on top of the cover. It can also be used to support waterproof tarps. Such covers and tarps can be sized to cover a broad variety of boat types including inboard and outboard bay style fishing boats, center console boats (with or without bow rails), deck boats (with or without walk thru windshields), ski and wakeboard boats, inflatable boats, jet boats, bass boats, runabouts, pontoon boats, performance boats, skiff boats, bowriders, whalers and cruisers, for example. It can also be used for non-power boats including row boats, Jon boats, kayaks and canoes.

Reference is now made to FIG. 1 in which there is illustrated an embodiment of a boat cover support apparatus of the subject invention (hereinafter referred to herein as "cover support apparatus" or simply, "support apparatus," and designated generally by reference numeral 10. All embodiments of support apparatus 10 are intended for use with boats supported on or by either a trailer, as exemplified in FIG. 9 for instance, or a boat hoist or lift (not shown) including but limited to bottom standing lifts, piling mount lifts, floating lifts, or shore or boat-mounted lifts (i.e., davits), for example.

Figure 2:
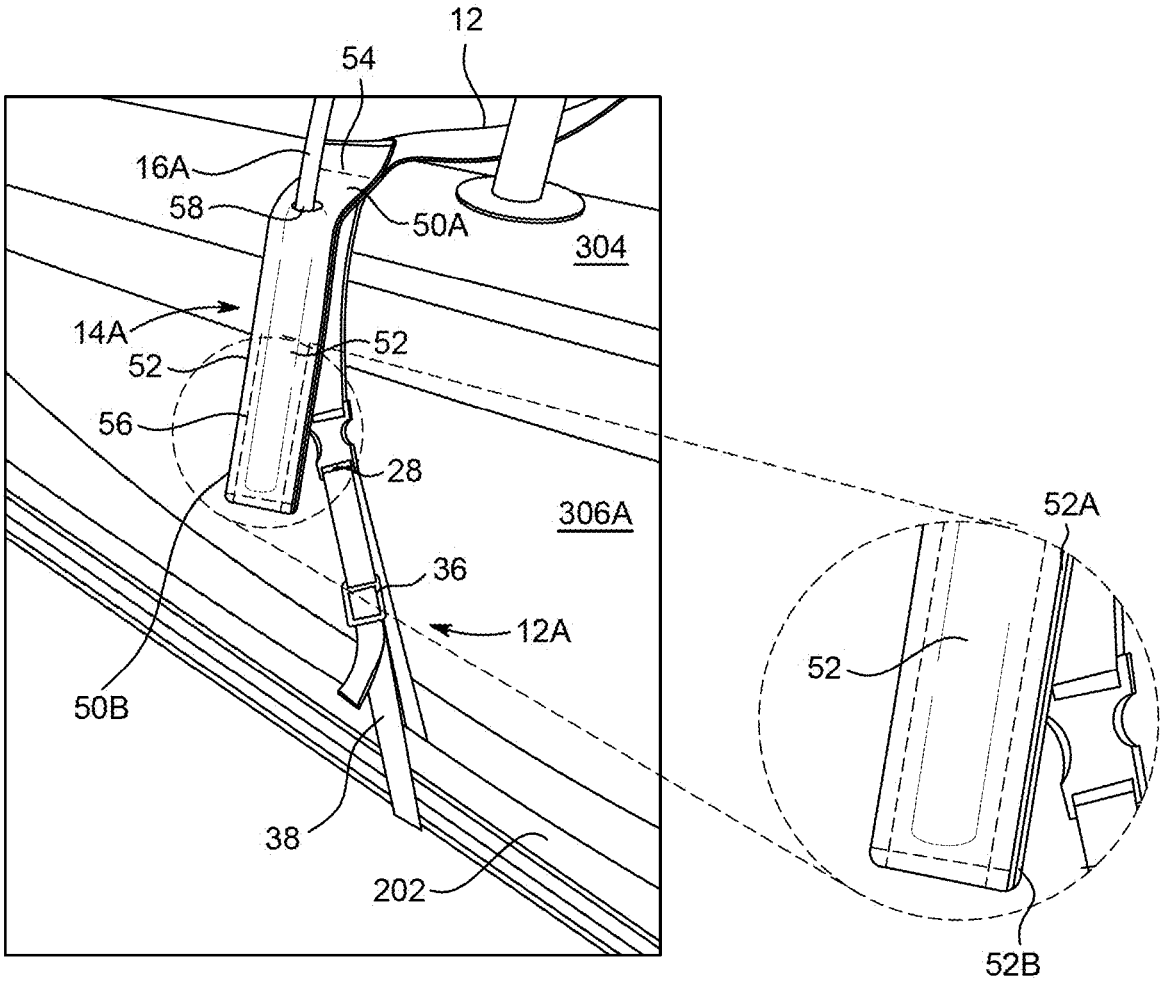
FIG. 2 is a perspective view of a first embodiment of the rod retention means of the boat cover support apparatus of FIG. 1 as mounted adjacent a gunwale of a trailer-mounted boat.
Figure 3:
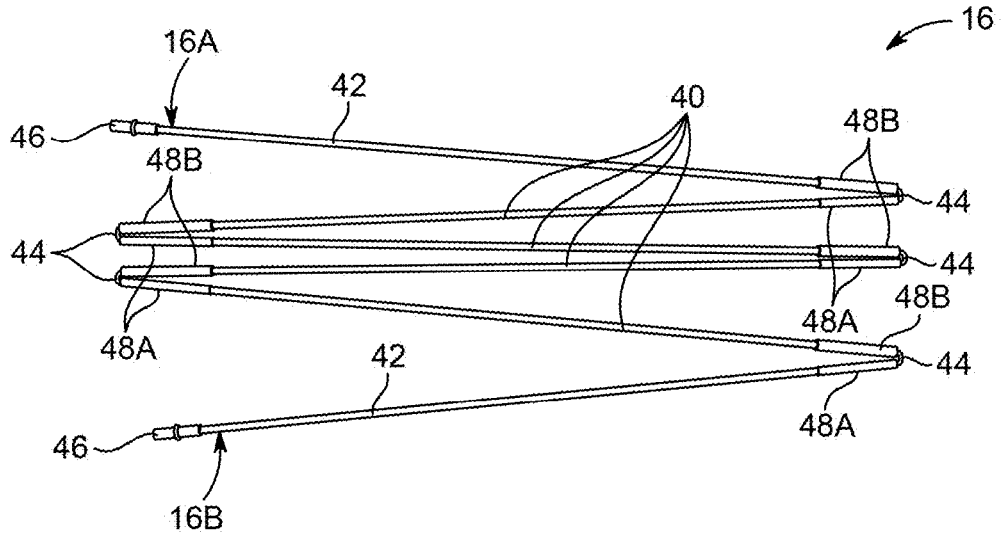
FIG. 3 is illustrates a collapsable support rod of the subject invention.

With additional reference to FIGS. 2 and 3, cover support apparatus 10 is comprised of four primary components, namely a tie-down strap 12 (also referred to herein more simply as "strap 12"), rod retention means 14 pivotally mounted to strap 12, and support rod 16. Together, strap 12 and rod retention means 14 form a mount for holding support rod 16 under tension in an arched configuration across opposing gunwales 306A and 306B of a boat in lieu of any mounting hardware that must be affixed to the boat itself, the latter being a practice that is undesirable by most boat owners.

In some embodiments, tie-down strap 12 may be of the loop strap variety (not shown) or linear variety. In some embodiments, loop straps are comprised of a single length of strap secured around the entire boat hull transversely to its longitudinal axis $A_L$ (FIG. 5) with its two ends joined together to form a loop. Loop straps may be more desirable than linear tie-downs when there are no points of attachment for the straps such as are afforded by trailers and some lifts. However, there must be access to the underside of the boat to thread the strap around its hull.

By contrast, a linear tie-down strap 12 (also referred to more simply as "strap 12") as shown in FIG. 1, has a length sufficient to span the beam of the boat to be covered and to be fastened around a pair of tie-down objects 202 located on opposite sides of the boat hull. Strap 12 is preferably constructed of webbing material, however, the term "strap" as used herein should be construed broadly to include cord, string, cable, chain, wire or the like, especially those of the marine grade quality. For the purpose of clarity, the term "webbing" means a strong fabric woven as a flat strip or tube of varying width and fibers, with synthetic fibers such as nylon, polypropylene or polyester being preferred. Strap 12 has opposing end portions 12A and 12B adapted for removable mounting to or around a tie-down object 202. The tie-down objects are located in relative close proximity to each side of the boat below its gunwales and may be, for instance, longitudinal I-beam framing members of a boat trailer around which strap ends 12A and 12B may be secured as shown. Each strap end portion 12A and 12B is configured into a size-adjustable loop having a loop buckle 36, preferably of the squeeze release variety or equivalent (also known as a "side release buckle"), for selectively opening or closing the loop by coupling or decoupling the buckle, and for resizing the loop in the conventional manner. In some embodiments, end portions 12A and 12B are detachable extensions of strap 12. A standard squeeze release buckle 28, for instance, may be employed for selective attachment and detachment of end portions 12A,12B to and from, respectively, the medial portion 12C of strap 12. The term "medial portion" is defined as that portion of strap 12 located between its end portions 12A and 12B. Medial portion 12C of strap 12 is preferably adjustable in length for deployment across boats of various beam widths. Length adjustability may be accomplished by the inclusion of at least one adjustment buckle 20 (also commonly referred to as a "strap adjuster," "strap tightener," "slider buckle" and "ladderlock buckle") along its length. Other types of adjustment buckles may also be employed including cam fasteners, over-center fasteners and ratchets, for example. In some embodiments, adjustment buckle 20 may also be separable into two subparts such as a squeeze release buckle, thereby dividing strap 12 into strap segments 18A and 18B, at least one of which is threaded through adjustment buckle 20 to create a free end portion 24 which may be pulled to reduce the length of strap 12, and/or to reduce or eliminate slack in strap 12 when mounted between a pair of tie-down objects 202. As should be readily appreciated, alternative arrangements of buckles and other fasteners in combination with tie-down strap may be employed to provide a removable mount for rod retention means 14.

With reference now being made to FIGS. 1 and 3 in particular, a support rod 16 of boat cover support apparatus 10 of the subject invention is illustrated. In a preferred embodiment, support rod 16 (aka "pole") is comprised of at least one interior pole section 40 between opposing end pole sections 42. Interior pole sections 40 and end pole sections 42 are cylindrical in shape, flexible and resilient in construction, preferably but not essentially equal in length to one another, and joined together in series with a shock cord 44 running through their hollowed interior. Each end pole section 42 may be equipped with a protective and blunted end cap 46 at one end. The opposite end of each end pole section 42 and each end of each interior pole section 40 terminate in connection means 48 which in the embodiment illustrated are comprised of male and female connectors 48A and 48B, respectively, for selectively joining the sections together. Interior pole sections 40 and end pole sections 42 may be constructed of materials selected to provide the desired degree of flexibility, strength and weight with aluminum and fiberglass being preferred. As may be appreciated, interior pole sections 40 and end pole sections 42 may be quickly, easily and selectively assembled together to form support rod 16 or disassembled and folded into a compact and portable unit.

As best observed by reference to FIGS. 1 and 2, a first embodiment of rod retention means 14, which may be generally characterized as being of the "soft" variety, meaning it is constructed from webbing. In this embodiment, rod retention means 14 is comprised of first rod holster 14A and second rod holster 14B, each being comprised of webbing material having a minimum length of about 3 inches, and a preferred length ranging from about 5 inches to about 6 inches. Each holster 14A,14B further includes proximal end 50A, distal end 50B, and a pocket 52 disposed therebetween. Proximal end 50A of each holster is fixedly attached to tie-down strap 12 via stitching to form connection seam 54 or via other suitable means, such that pocket 52 of the holster hangs freely from the seam in pivoting fashion and, when the subject boat cover support apparatus 10 is in use, each pocket 52 is positioned to hang freely from the outer edges 304A,B of the boat's gunwales 302A,B. Seams 54 of each holster 14A,14B each, therefore, form a pivot from which pockets 52 depend. Each pocket 52 is comprised of front panel 52A and back panel 52B, the former on top of the latter in coplanar relationship and joined together via perimeter stitching 56 around at least the bottom half of each pocket. Access to the interior space of the pocket is provided by opening 58 disposed through front panel 52A, proximate seam 54. Opening 58 may be created by making a slit through front panel 52A which is reinforced about its perimeter with stitching or a grommet (not shown). The interior space of each pocket 52 has a minimum depth of about 1 inch, and a preferred depth ranging from about 3 inches to about 4 inches. Greater depths are also possible, but depths greater than about 6 inches are considered excessive and impractical.

Installation

Figure 4:
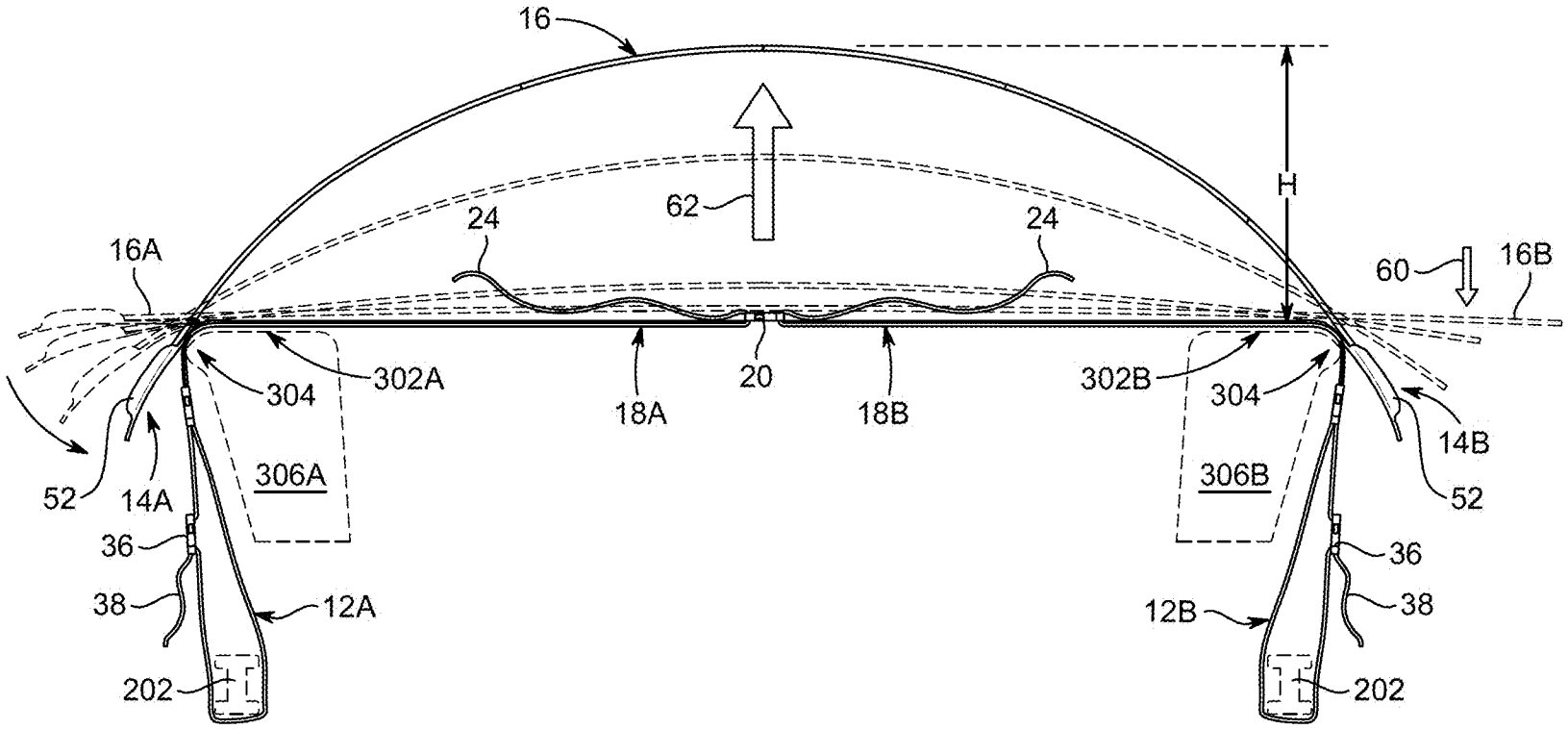
FIG. 4 illustrates progressive bending of the rod component of the boat cover support apparatus into a bow shape for retention within an embodiment of the rod retention means ("holsters") of the subject invention.

With continued reference to FIG. 2 and additional reference to FIG. 4, a method of installation of an embodiment of the subject boat cover support apparatus 10 on a trailer supported boat shall be described. Generally, tie-down strap 12 is draped over opposing boat gunwales 302A,302B in any location where elimination of cover sagging is sought to be eliminated. More specifically, medial portion 12C of tie-down strap 12 is draped across opposing gunwales 302A and 302B of a boat 300 with the pivot point of rod retention means 14 in close proximity to the outer edges 304 of gunwales 302A,B, such that the holsters hang freely adjacent the outside surface of boat walls 306A,B. First and second end portions 12A and 12B, respectively, of strap 12 are secured around an available attachment point of an attachment object 202, typically the underlying frame of a trailer 200 or other boat support structure. Alternatively, a loop strap (not shown) may be mounted around boat 300 when it is feasible and practical to do so. Slack is removed from the tie down assembly 12 by tightening at least one of the free ends 24 of first and second tie-down strap segments 18A,18B and/or at least one of the free ends 38 of first and second end portions 12A and 12B, respectively, of strap 12. Rod 16 when assembled has a first end 16A and second end 16B. First end 16A of rod 16 is inserted into rod retention means 14. In the embodiment illustrated, first end 16A is more specifically inserted through opening 58 and into pocket 52 of corresponding first rod holster 14A and the rod is laid horizontally across gunwales 302A,302B such that its second end 16B extends beyond the outer edge 304 of gunwale 302B in cantilevered fashion. Downward pressure is applied to second end 16B of rod 16 as indicated by directional arrow 60 which causes the body of rod 16 to bow upwardly as indicated by directional arrow 62 into an arched shape having an arch height H, and first end 16A to pivot downwardly and inwardly towards the exterior of boat side wall 306A. Rod 16 is bowed until second end 16B can be inserted into rod retention means 14 located on the opposite side of the boat and, more specifically, into pocket 50 of second rod holster 14B. Thusly mounted, first and second ends 16A,B extend outwardly and downwardly beyond the outer edges 304 of gunwales 302A,B and the potential energy within rod 16 resulting from its flexed state exerts an outward force on first and second rod ends 16A,B away from boat side walls 306A,B, respectively. The number and/or length of interior pole sections 40 may be selectively modified to adjust the overall length of rod 16 and the corresponding desired arch height H. Additionally, by attaching each holster 14A,B to tie-down strap 12 along a single attachment point (seam 54) so that they hang freely and are capable of pivotal movement, rod 16 need not be hyperextended to accomplish insertion into and retention in holster pockets 52. As may be appreciated, hyperextension can cause undue stress on the rod and result in cracking or breaking.

Figure 5:
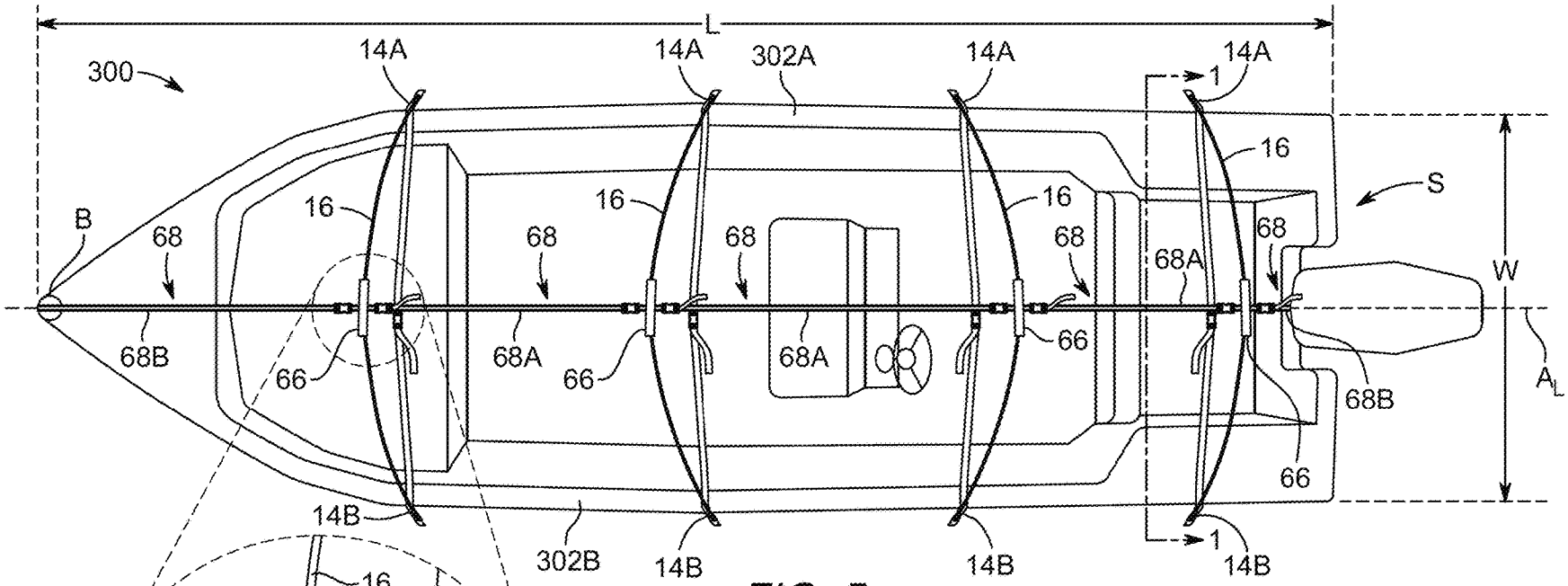
FIG. 5 is a top perspective view of an embodiment of a boat cover support system of the subject invention as mounted to a trailer-mounted boat.
Figure 8:
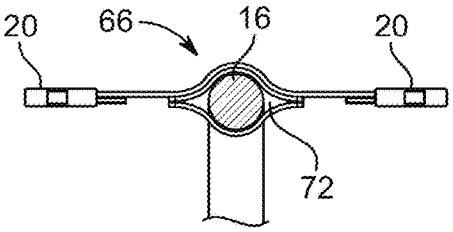
FIG. 8 is a side sectional view of the fore-to-aft stabilizer assembly along line 8-8 of FIG. 6.
Figure 7:
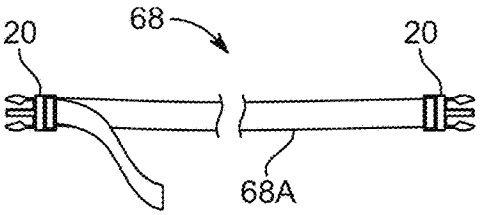
FIG. 7 is an embodiment of a connection strap of the fore-to-aft stabilizer assembly of FIG. 6.
Figure 6:
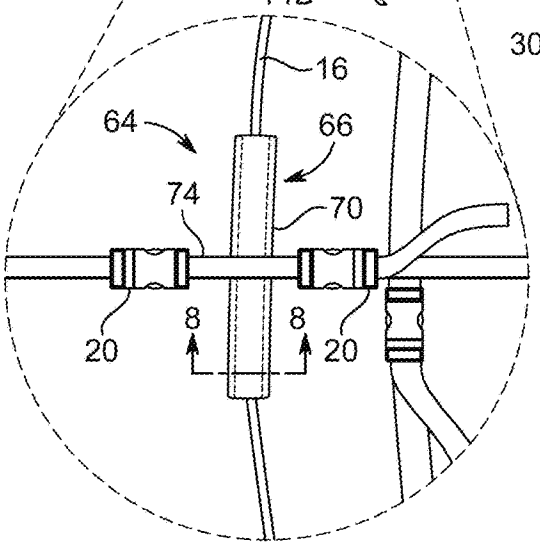
FIG. 6 is an enlarged view of a fore-to-aft movement stabilizer assembly of the boat cover support system of FIG. 5.

Referring now to FIGS. 5-8, embodiments of the subject boat cover support apparatus of the subject invention further include a rod stabilization assembly 64 to prevent tipping of rod 16 forward or backward when mounted to a boat in its arched configuration. As may be appreciated, because of the relatively soft nature of the webbing used to create the above-described rod retention means 14 as shown in FIGS. 1, 2 and 4, when mounted therein, rod 16 is prone to tipping forward (towards boat bow B) or backward (toward boat stern S). To some extent, the weight of a boat cover supported by rod 16 will prevent this occurrence. However, to completely prevent any substantial movement of rod 16 perpendicular to its longitudinal axis, a rod stabilization assembly 64 may be employed. In one embodiment, rod stabilization assembly 64 comprises a mount 66 connected to rod 16 in proximity to its midpoint (i.e., at the arch apex), and a length adjustable stabilizer straps 68. In one embodiment, mount 66 is comprised of sleeve 70 having a longitudinal channel 72 through which rod 16 is disposed, and transverse connection strap 74. Sleeve 70 and connection strap 74 are constructed of webbing and are fixedly attached to one another at their midpoints in perpendicular fashion. For embodiments of the subject boat cover support apparatus where at least two support rods 16 are employed, a mount-to-mount stabilizer strap 68A (FIG. 7) is disposed between each pair of mounts 66, and a pair of mount-to-boat stabilizer straps 68B are disposed between the boat bow B and the foremost mount 66, and between the boat stern S and the aftmost mount 66, as best illustrated in FIG. 5. As should be readily understood by those reasonably skilled in the art, stabilizer straps 68A,68B are disposed between boat bow B, boat stern S, and intervening mounts 66, all in series and connected under tension via fasteners 20 to maintain each rod in a plane normal to the surface of the boat deck. Mount-to-boat stabilizer straps may be attached to bow B and stern S at available attachment points such as cleats, slots, O-rings or the like using a variety of different attachment means (not shown). At least one boat cover support apparatus 10 in combination with a rod stabilization assembly 64 as described constitutes a boat cover support system 100 of the subject invention.

Figure 9:
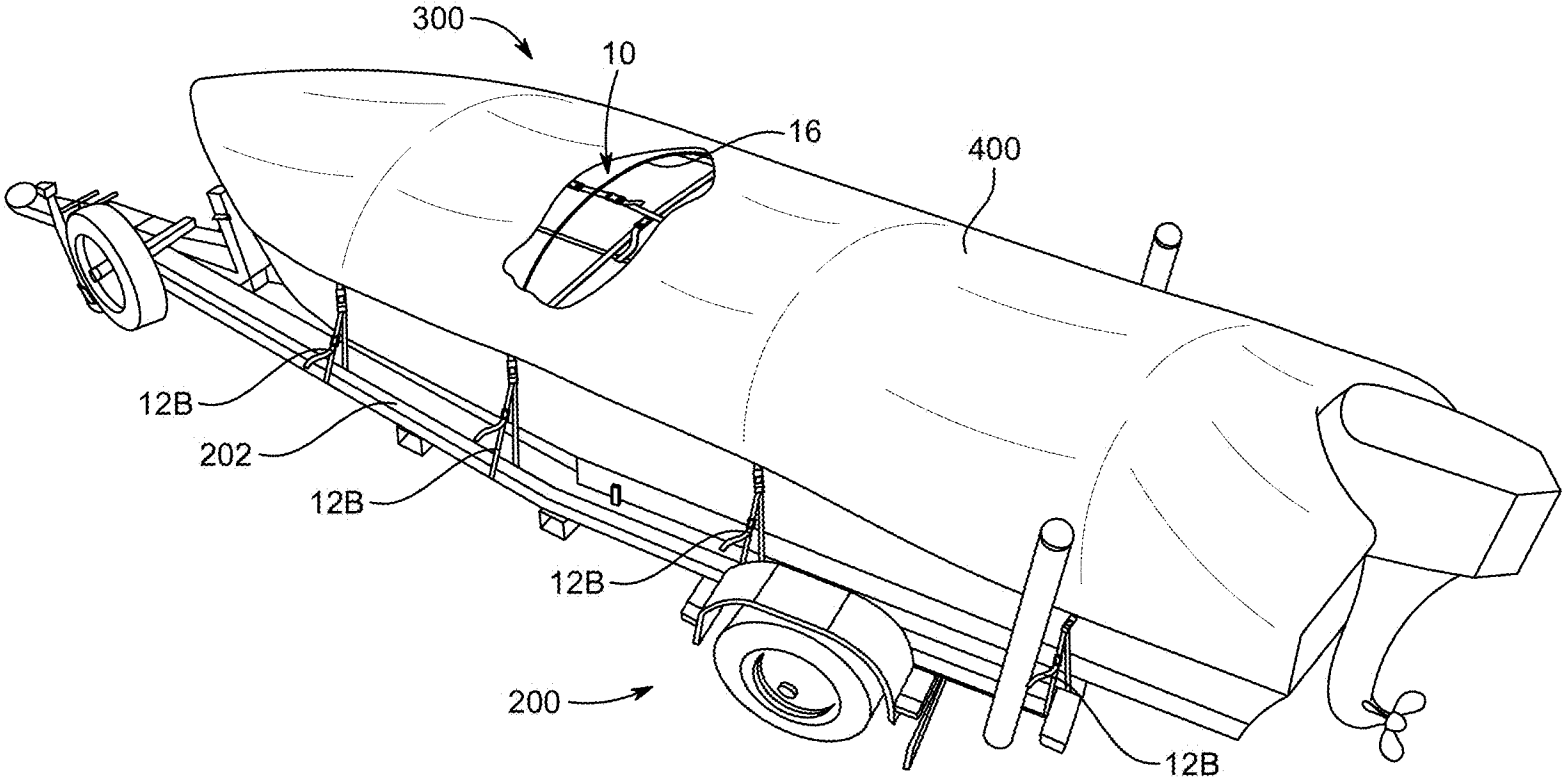
FIG. 9 is a left rear perspective view of a boat cover, a portion of which is illustrated in cutaway view, installed over a boat cover support apparatus of the subject invention.

Referring now to FIG. 9, a perspective view of a boat cover 400 installed over a boat cover support system 100 of the subject invention which in turn is installed on a boat 300 loaded on a trailer 200. For the sake of simplicity, no boat cover tie downs are shown. It should now be readily appreciated that deployment of a boat cover support apparatus 10 underneath boat cover 400 in areas where the cover would otherwise be prone to sagging prevents the local pooling of water. When combined with a road stabilization assembly, the resulting boat cover support system 100 provides a stable and robust means for facilitating the shedding of water from an installed boat cover, the system being capable of rapid deployment and breakdown into a highly compact and portable kit that can be stored in small compartments of the boat. Importantly, the subject boat cover support apparatus 10 and system 100 may be used with nearly any existing boat cover, the apparatus and system being relatively universal in nature.

Figure 10A:
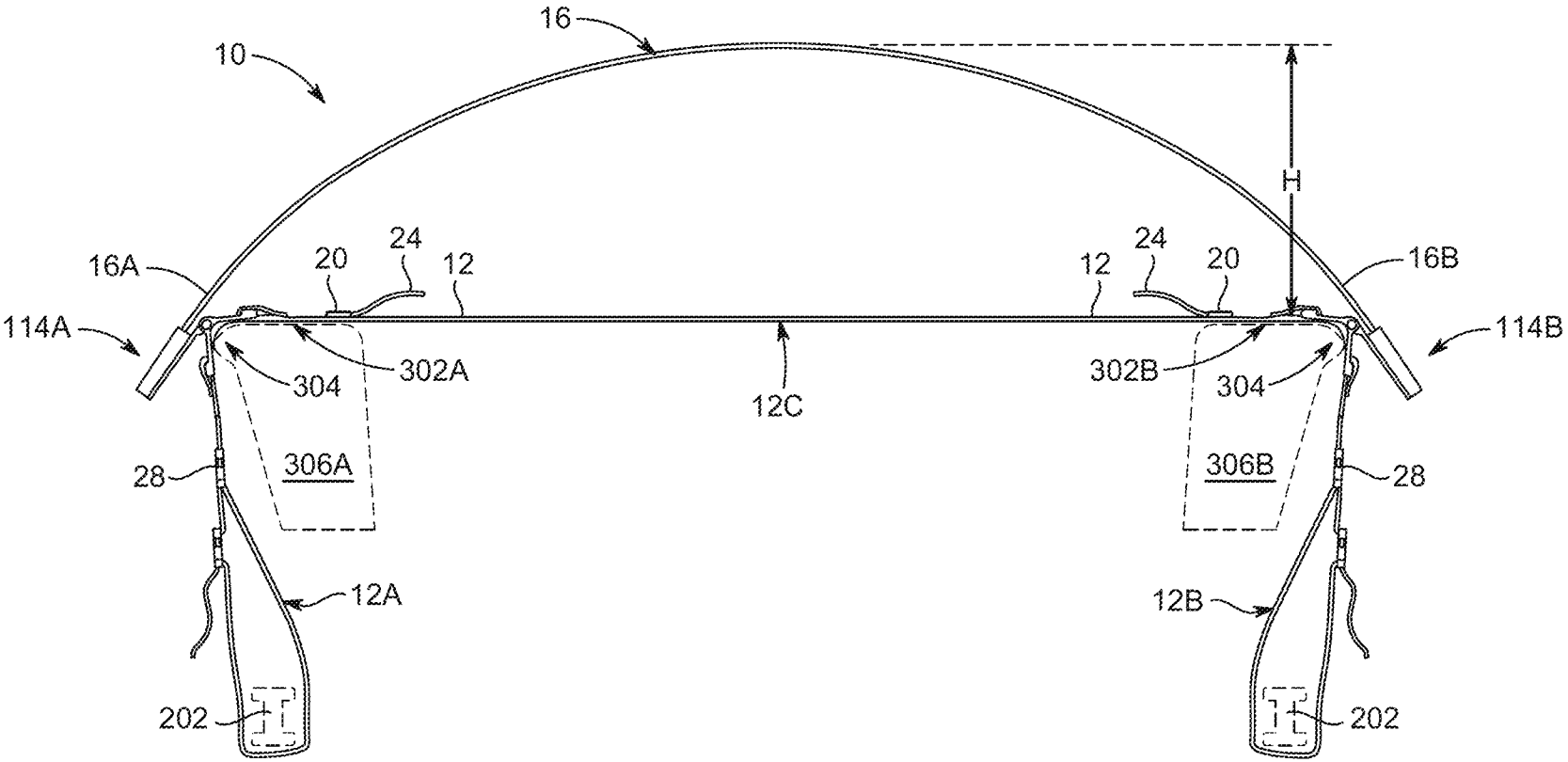
FIG. 10A is a front sectional view of a second embodiment of the boat cover support apparatus of the subject invention shown attached to a trailer-mounted boat, certain details of which have been removed for the sake of simplicity.
Figure 10B:
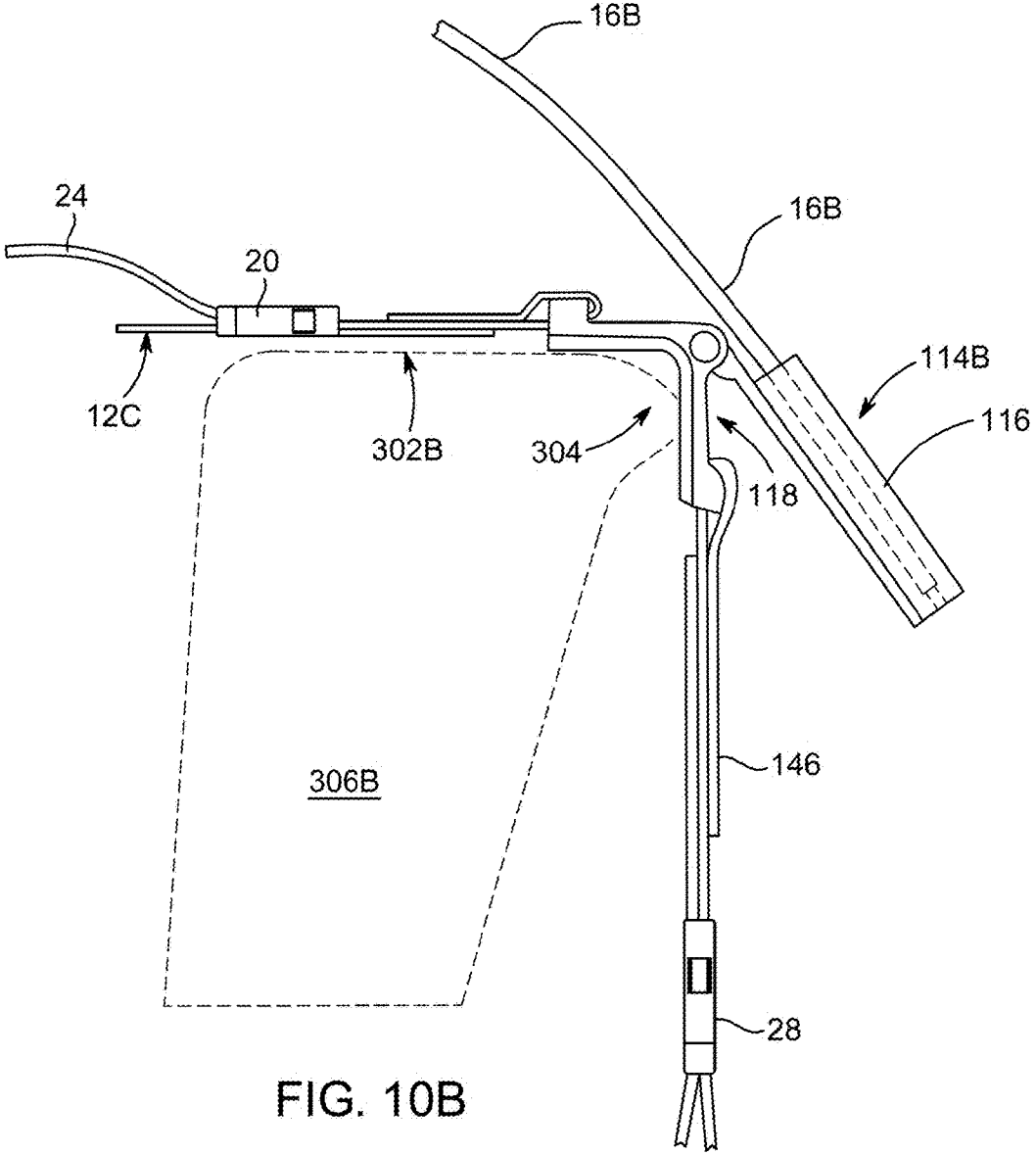
FIG. 10B is an enlarged view of the right-side rod retention means of the embodiment illustrated in FIG. 10A.
Figure 11:
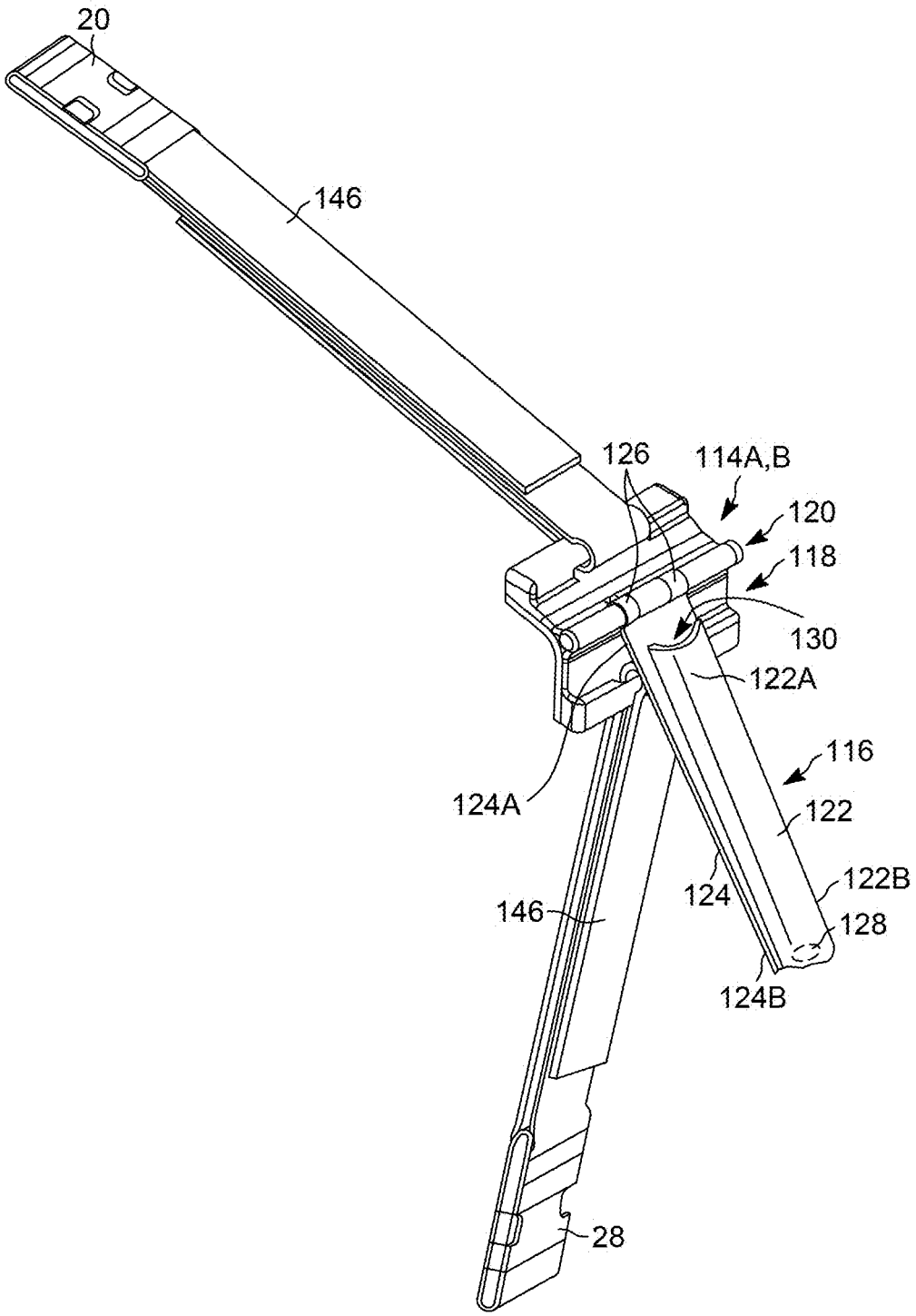
FIG. 11 is an isometric view of a rod retention assembly of the subject invention comprising a second embodiment of the rod retention means.
Figure 12:
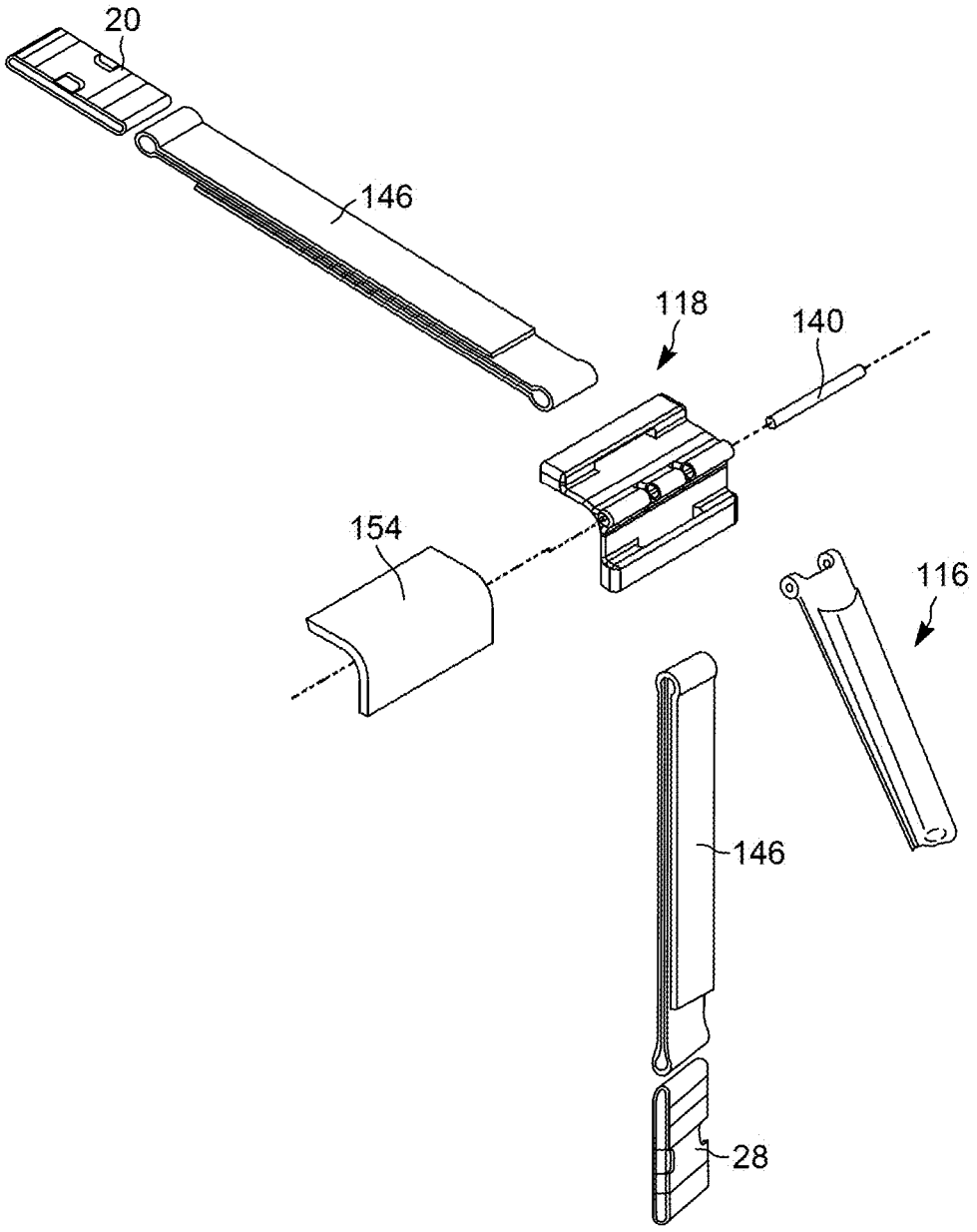
FIG. 12 is an exploded view of the rod retention assembly of FIG. 11.
Figure 13:
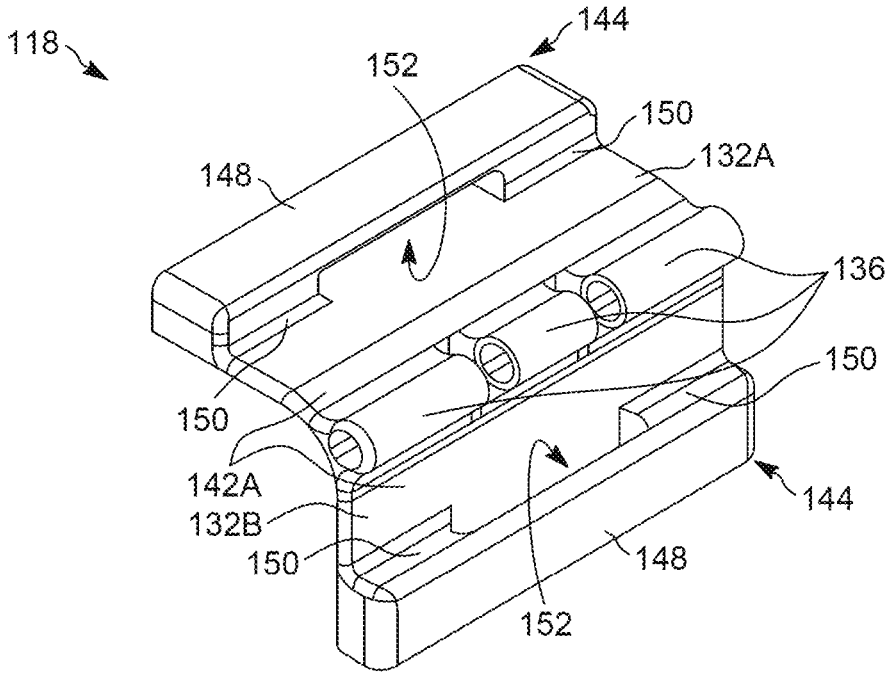
FIG. 13 is an isometric view of an angle bracket component of the rod retention assembly of FIG. 11.
Figure 14:
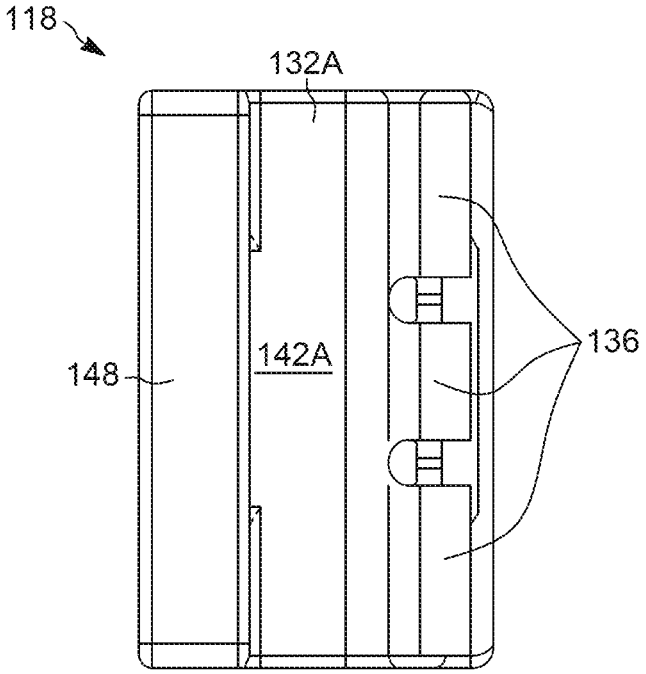
FIG. 14 is a plan view of the angle bracket of FIG. 13.
Figure 15:
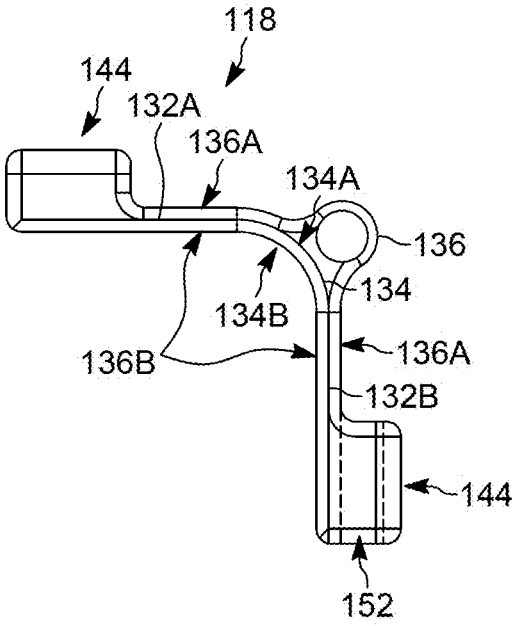
FIG. 15 is a side elevation view of the angle bracket of FIG. 13.
Figure 16:
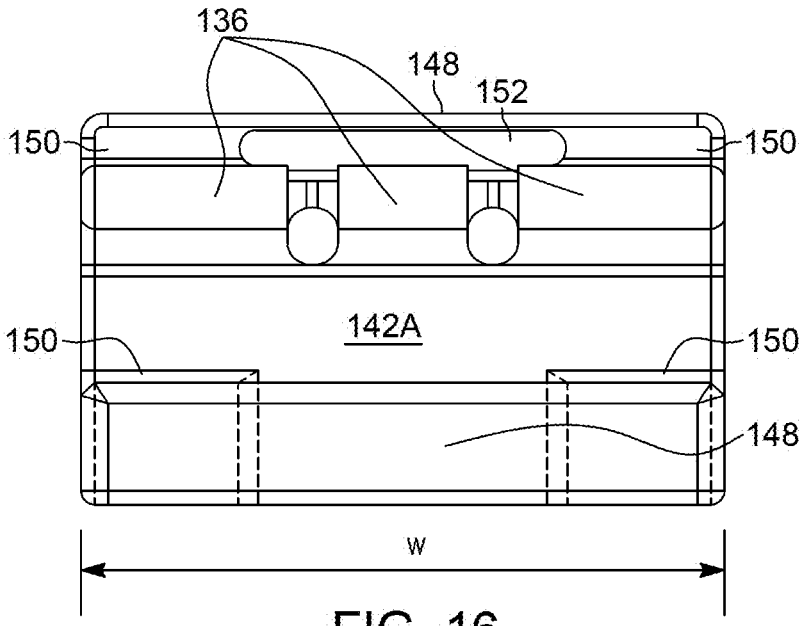
FIG. 16 is a front elevation view of the angle bracket of FIG. 13.
Figure 17:
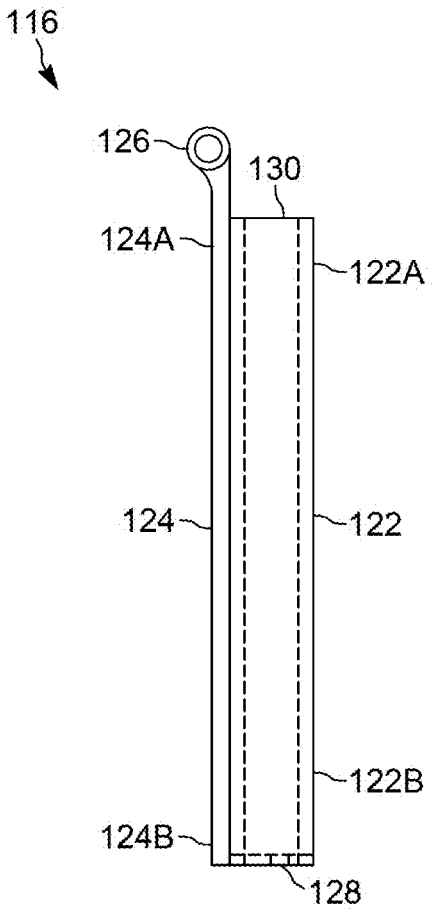
FIG. 17 is a side elevation view of the rod retention holster of FIG. 10.
Figure 18:
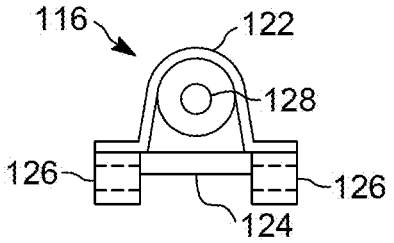
FIG. 18 is a plan view of the rod retention holster of FIG. 10.

Reference now being made to FIGS. 10A and 10B, an alternate embodiment of a boat cover support apparatus 10 of the subject invention is comprised of rod retention means 14 comprising a first rod holster assembly 114A and a second rod holster assembly 114B, each disposed between first end portion 12A and second end portion 12B of tie-down strap 12, and a support rod 16 having a first end 16A detachably mounted to first rod holster assembly 114A and a second end 16B detachably mounted to second rod holster assembly 114B. Together, tie-down strap 12 and rod retention means 14 form a mount for holding support rod 16 under tension in an arched configuration across opposing gunwales 306A and 306B of a boat.

Each rod holster assembly may be generally characterized as being of the "hard" variety, meaning its primary components are constructed of rigid materials such as plastics, metals, metal alloys and the like. In some embodiments, first and second rod holster assemblies 114A,114B are each comprised of a rod holster 116 pivotally mounted to an angle support 118, via hinge 120. Each rod holster 116 has a minimum length of about 3 inches, and a preferred length ranging from about 5 inches to about 6 inches. Rod holsters 116 may be constructed of metal, an engineered plastic such as Delrin brand acetal homopolymer, or other materials having similar properties of high strength, stiffness, dimensional stability, low friction, and high wear resistance. Rod holster 116 is comprised of receiver 122 mounted to or integrally formed with a backing plate 124. Receiver 122 has a hollow body and is preferably cylindrical in shape having an interior surface that is preferably circular in cross section. Receiver 122 has a proximal end 122A and a distal end 122B, the former being in closer proximity to hinge 120 than the latter. Similarly, backing plate 124 has a proximal end 124A and distal end 124B. Proximal end 124A includes a pair of holster knuckles 126 that form a part of hinge 120. In some embodiments, holster knuckles 126 are rearwardly canted (relative to receiver 122). Each receiver 122 is sized to receive and securely retain either end portion 16A or 16B of rod 16, preferably but not essentially via frictional engagement. The interior space of each receiver 122 has a minimum depth of about 1 inch, and a preferred depth ranging from about 3 inches to about 4 inches. Greater depths are also possible, but depths greater than about 6 inches are considered excessive and impractical. In some embodiments, distal end 122B of receiver 122 includes a drain hole 128 to shed any water that may otherwise become trapped within receiver 122. The proximal end 122A of receiver 122 includes an opening 130 through which rod 16 may be received for mounting of the rod in the receiver.

Referring to FIGS. 11-18, angle support 118 is generally L-shaped in profile (FIG. 15) having first and second support plates 132A and 132B, respectively, which are substantially perpendicular to one another and connected by elbow joint 134 which has a front side surface 134A and a back side surface 134B, the latter being preferably curved in profile. Three spaced angle support knuckles 136 extend radially from front side 134A of elbow joint 134 and together with holster knuckles 126 mate together in axial alignment to form hinge barrel 138 which is held together by hinge pin 140. Hinge pin 140 is preferably constructed of stainless steel, aluminum or Delrin, but may also be constructed of a similar material selected for its high strength, stiffness, dimensional stability, low friction, and high wear and corrosion resistance. First and second support plates 132A,B each have a front side surface 142A and back side surface 142B. Each of first and second support plates 132A,B include a strap mount 144 for attachment of a leader strap 146. In some embodiments, strap mounts 144 are comprised of a bridge 148 supported above front side surface 142A in parallel alignment with hinge 120 by a pair of spaced risers 150 to form mount openings 152 through which a leader strap 146 may be threaded for the purpose of mounting in a manner well understood in the art. Each angle support 118 includes a liner 154 fixedly attached to back side surface 134B of each of first and second support plates 132A,B. Liners 154 are preferably made of hard rubber and serve to protect outer edges 304 of boat gunwales 302A,B over which angles supports 118 are positioned for proper positioning of first and second rod holster assemblies 114A,B. Angle support 118 may be constructed of metal, Delrin, or other materials selected for high strength, stiffness, dimensional stability, low friction, and high wear and corrosion resistance.

Figure 19:
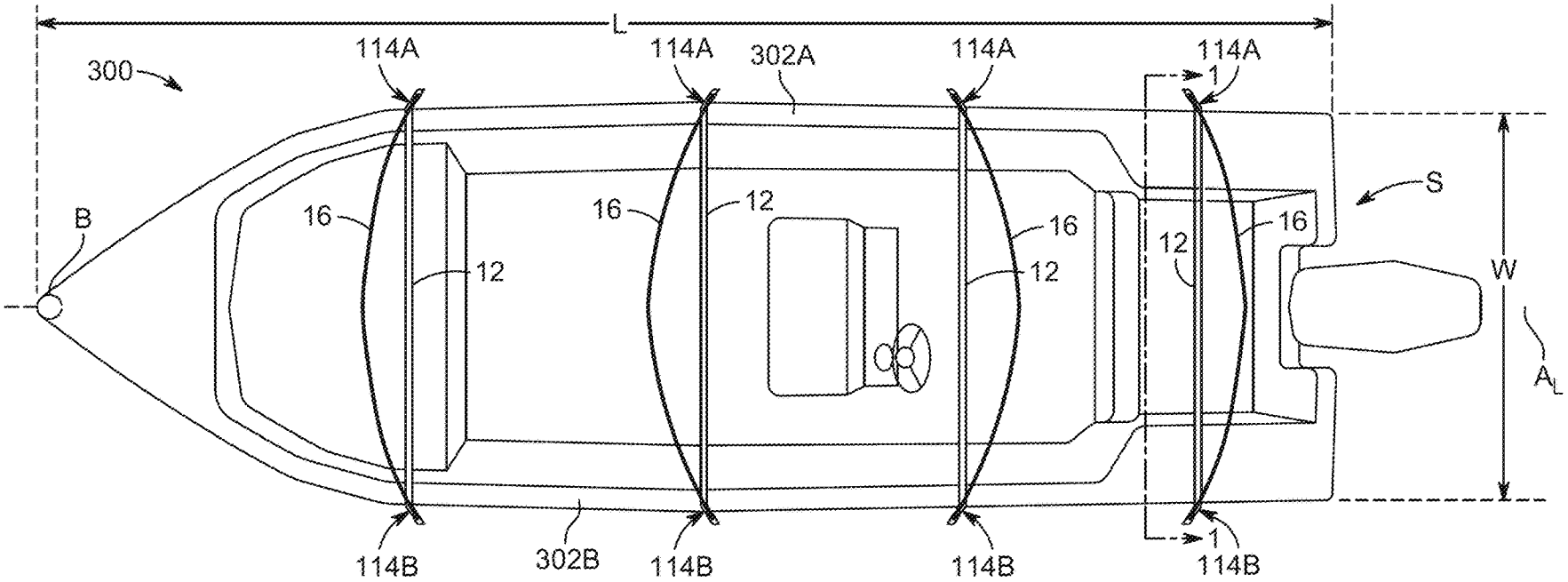
FIG. 19 is a top perspective view of a second embodiment of the boat cover support system of the subject invention as mounted to a trailer-mounted boat.
Figure 20:
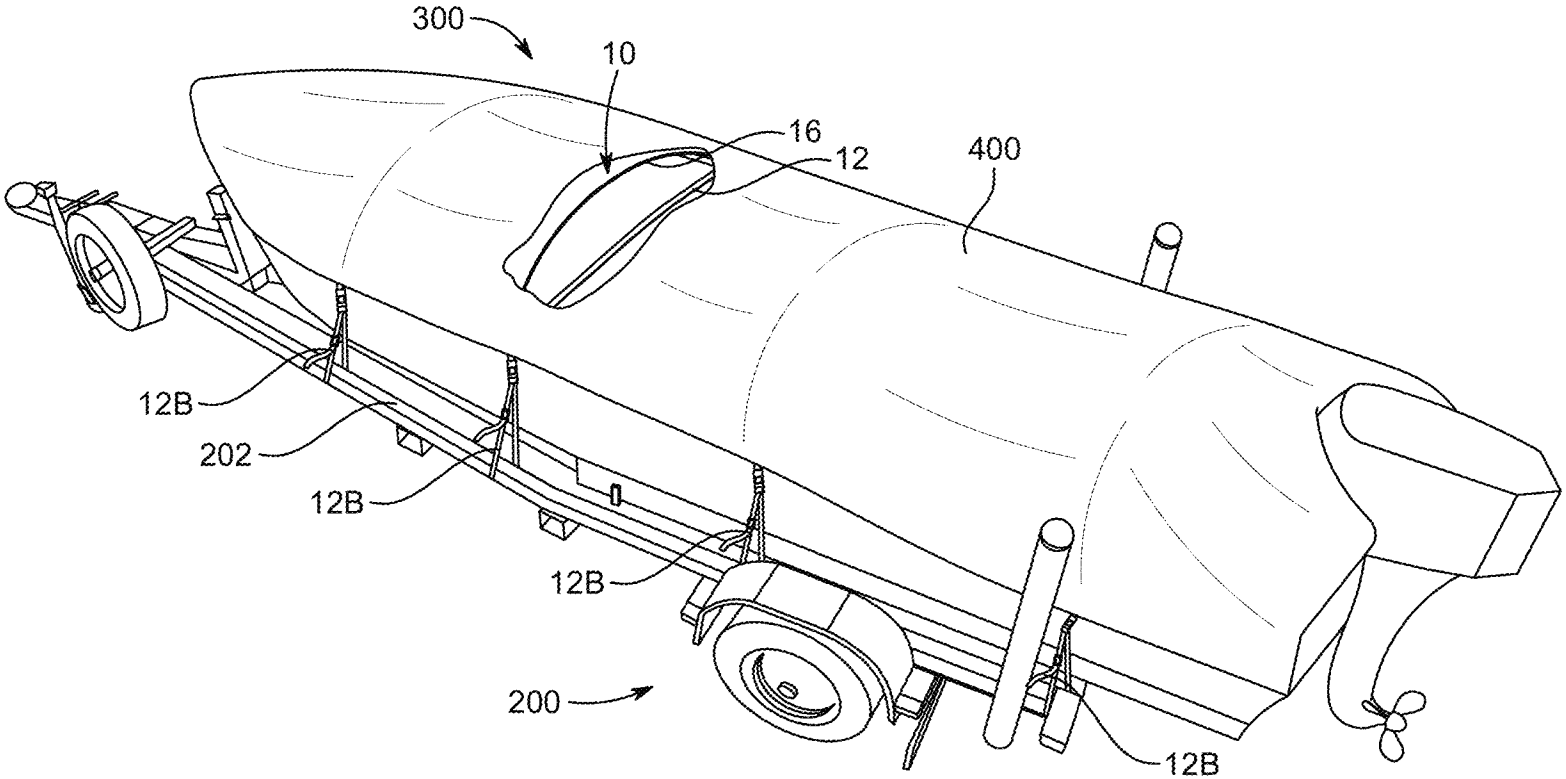
FIG. 20 is a left rear perspective view of a boat cover, a portion of which is illustrated in cutaway view, installed over a second embodiment of a boat cover support apparatus of the subject invention.

As should be readily appreciated, the hinged connection of rod holsters 116 and angle supports 118 permits the former to pivot about its axis of rotation, but prevents movement in any other direction. Accordingly, when opposite ends 16A,B of a rod 16 are mounted within a pair of mounted rod holsters 116, such as depicted in FIGS. 10A, 19 and 20, the rod is prevented from tipping forward towards the bow B of the boat, or backwards towards stern S of the boat. Thusly mounted, no rod stabilization assembly 64 is necessary. To further promote stability and prevent bow-to-stern tipping of rod 16, the amount of surface area of first and second support plates 132A,B in contact with underlying boat gunwales 302A and 302B, either directly or via liners 154 may be increased to prevent movement of each rod holster assembly 114A,B. As should be apparent to those possessing ordinary skill in the art, the wider the width W of each angle support 118 (parallel to hinge 120), the less prone rod 16 will be to forward or backward tipping. Width W of each first and second support plates 132A,B is at least 3" and is preferably from about 3 inches to about 4 inches. While wider supports are possible, they become more cumbersome to store and transport.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

The invention claimed is:

1. An apparatus for supporting a boat cover on a trailer- or lift-mounted boat, the apparatus comprising, a. a flexible resilient rod adapted to span in arched configuration opposing gunwales of the boat for supporting a boat cover thereon and above the boat, said rod having a first end portion and a second end portion;

b. first rod retention means adapted for removable retention of said first end portion of said rod;

c. second rod retention means adapted for removable retention of said second end portion of said rod; said first rod retention means and said second rod retention means each being comprised of a rod holster having a proximal end, a distal end, and a pocket disposed between said proximal end and said distal end for receiving said first end portion or said second end portion of said rod therein; and d. a length-adjustable tie-down strap having a length sufficient to span the beam of the boat to be covered and to be fastened around a pair of tie-down objects located on opposite sides of the boat and below its gunwales; said proximal end of each said rod holster being pivotally mounted to said tie-down strap;

whereby each said pocket of each said rod holster hangs freely from said tie-down strap in pivoting fashion.

2. An apparatus for supporting a boat cover on a trailer- or lift-mounted boat, the apparatus comprising, a. a flexible resilient rod adapted to span in arched configuration opposing gunwales of the boat for supporting a boat cover thereon and above the boat, said rod having a first end portion and a second end portion;

b. first rod retention means adapted for removable retention of said first end portion of said rod;

c. second rod retention means adapted for removable retention of said second end portion of said rod; said first rod retention means and said second rod retention means are each comprised of an angle support and a rod holster; said angle support being generally L-shaped in profile having a first plate connected to a second plate by an elbow joint in substantially perpendicular orientation; said rod holster comprising a hollow body receiver sized to receive said first end portion or said second end portion of said rod therein; and d. a length-adjustable tie-down strap having a length sufficient to span the beam of the boat to be covered and to be fastened around a pair of tie-down objects located on opposite sides of the boat and below its gunwales; said rod holster being pivotally mounted to said angle support; said angle support being attached to said tie-down strap.

3. The boat cover support apparatus of claim 2, wherein each said angle support and said rod holster are pivotally connected via a hinge.

* * * * *